US005351633A

United States Patent [19]

Buckner

[11] Patent Number: 5,351,633

[45] Date of Patent: Oct. 4, 1994

[54] BALANCED PRESSURE SOLID FUEL HEATING UNIT

[75] Inventor: Carrol E. Buckner, Fletcher, N.C.

[73] Assignee: Dovetech, Inc., Fletcher, N.C.

[21] Appl. No.: 992,964

[22] Filed: Dec. 16, 1992

Related U.S. Application Data

[63] Continuation of Ser. No. 449,051, Feb. 26, 1990, abandoned, which is a continuation of Ser. No. 170,239, Mar. 18, 1988, abandoned.

[51] Int. Cl.[5] ..... F23B 7/00

[52] U.S. Cl. ..... 110/233; 110/102; 110/110; 110/160; 110/297; 126/58

[58] Field of Search ..... 110/110, 233, 101 C, 110/102, 160, 297; 126/58

[56] References Cited

U.S. PATENT DOCUMENTS

| | | | |
|---|---|---|---|
| 1,604,271 | 10/1926 | Friedman | 110/160 |
| 1,952,023 | 3/1934 | Reeves . | |
| 3,961,587 | 6/1976 | Ozawa | 110/160 X |
| 4,017,254 | 4/1977 | Jones | 110/233 X |
| 4,312,278 | 1/1982 | Smith et al. . | |
| 4,377,116 | 3/1983 | Satake | 110/110 X |
| 4,454,827 | 6/1984 | Smith et al. . | |
| 4,517,903 | 5/1985 | Richmond et al. | 110/233 |
| 4,545,309 | 10/1985 | Comtois . | |
| 4,565,184 | 1/1986 | Collins et al. . | |
| 4,782,765 | 11/1988 | Miller et al. . | |
| 5,001,993 | 3/1991 | Gramlow | 110/233 |
| 5,133,266 | 7/1992 | Cullen | 110/233 |

OTHER PUBLICATIONS

International Search Report dated Mar. 17, 1992.

*Primary Examiner*—Edward G. Favors
*Attorney, Agent, or Firm*—Wigman, Cohen, Leitner & Myers

[57] ABSTRACT

A pellet fuel burning heating unit having a firebox with a burner therein connected to a combustion air duct, an exhaust pipe to remove combustion gases from the firebox, a blower to provide combustion air and a pressure regulator and air splitter to divide the air flow from the blower into the combustion air duct and into the exhaust pipe. The air flow into the combustion air duct creates a positive pressure in the burner and the air flow into the exhaust pipe creates a suction of the exhaust gases in the firebox.

18 Claims, 3 Drawing Sheets

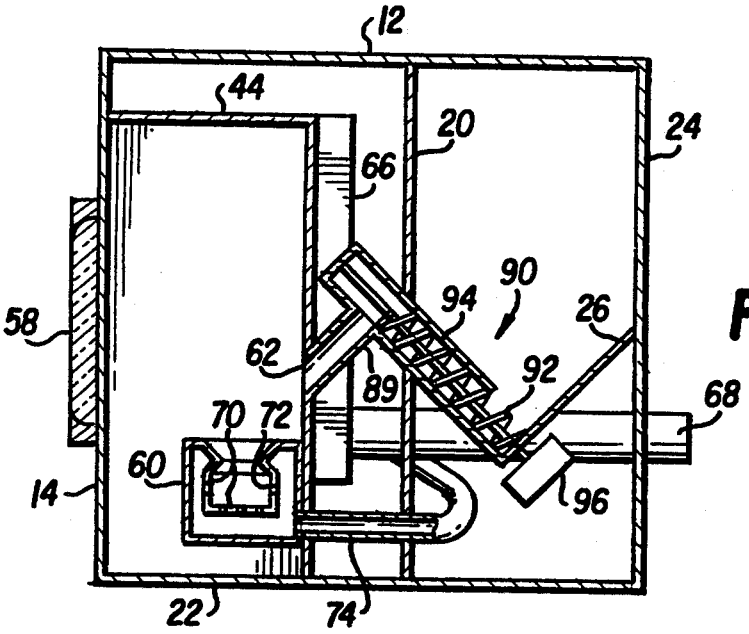
FIG. 3
FIG. 5
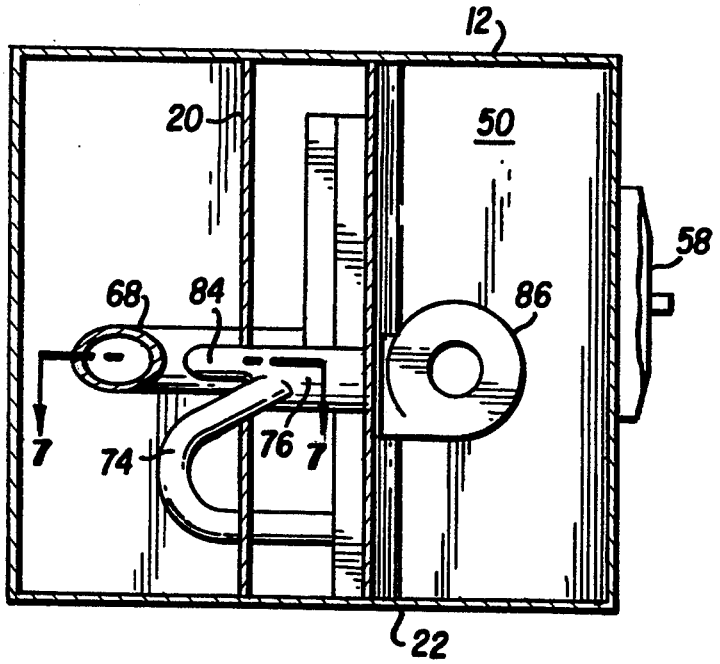
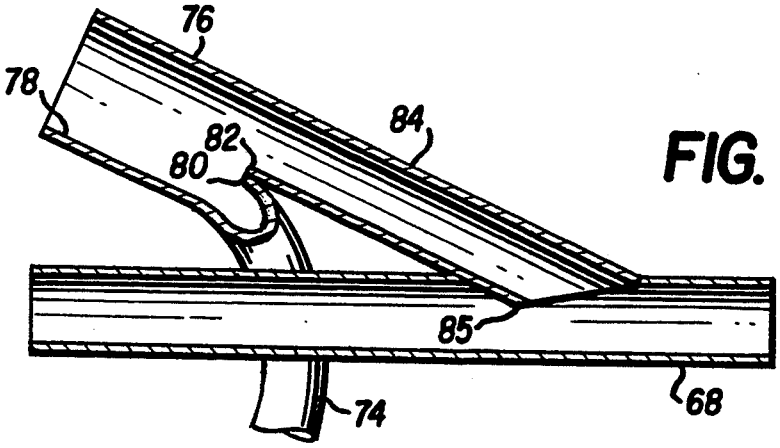
FIG. 7

BALANCED PRESSURE SOLID FUEL HEATING UNIT

This is a continuation of Ser. No. 07/449,051 filed Feb. 26, 1990, abandoned which is a continuation of Ser. No. 07/170,239 filed Mar. 18, 1988, now abandoned.

BACKGROUND OF THE INVENTION

The present invention relates generally to stoves or furnaces used as heating units and more particularly, to stoves or furnaces that utilize pellet type fuel.

The use of wood burning stoves is very common particularly in those areas where wood logs can be secured fairly inexpensively. In urban areas, the use of wood as an energy source is not as popular because the cost of wood is high and also because the use of wood logs is considered by many to be an annoyance requiring constant cleaning of the area around the heating unit and the need to constantly bring the wood logs to the unit. Also, the problems involving creosote build-up and the release of hydrocarbon pollutants into the atmosphere have dissuaded many people away from the use of wood or coal as an energy source.

To overcome the aforementioned problems, attempts have been made to develop heating units that would burn a cleaner, easier to handle fuel such as wood pellets. The concept was that the pellets could be packaged in a bag and readily purchased at a neighborhood store. The heating units had a hopper that would hold a large supply of the pellets and the pellets would be automatically fed into the burner thereby relieving the user of the need to constantly move logs into the heating unit. U.S. Pat. Nos. 4,513,671 and 4,517,903 show pelletized wood furnaces.

The wood pellet heating unit has not met with a great deal of success for several reasons. The supply of the fuel source is dependent upon a limited number of producers and many potential users may have concerns of having a readily available supply. Also, the heating units have not been as efficient with respect to the fuel burning and the heat output as the more typical wood log heating units. One technical problem is with the methods of providing air for the fuel. Most pellet heating units use a blower to move outside air, either from the area surrounding the unit or from the outside of the building, into the burner portion of the heating unit. If the blower is located upstream of the burner, the unit is said to be a positive pressure since the firebox will have a pressure greater than atmospheric. U.S. Pat. No. 4,517,903 is a positive pressure system since the blower is located in front of the fuel burner and the combustion air is pushed into the burner area. Patent No. 4,513,671 is a negative pressure system since the blower is located beyond the fuel burner and the combustion air is essentially sucked into the burner with the firebox having a pressure slightly less than atmospheric.

The use of either positive or negative pressure presents several problems that may contribute to lack of acceptance of the pellet heating units. With the positive pressure unit, the firebox is under pressure so that when the door or other access to the firebox is opened, smoke and other matter will be pushed into the room. In the negative pressure unit, there is a tendency for the blower to clog from the particulate material in the exhaust gases and also a considerable amount of heat is sucked out of the heating unit into the exhaust pipe tending to generate a fairly high temperature at the exhaust pipe.

Thus there exists a need for a pellet fuel stove or furnace that can overcome all of the aforementioned problems and accordingly, it is one object of the invention to provide an heating unit using pellet fuel which will overcome said problems.

It is another object of this invention to provide a pellet fuel heating unit that uses both a negative and positive pressure system and avoids the problems associated with either type of system.

Yet another object of this invention is to provide a heating unit having a balanced pressure system that will not only burn wood pellets but will burn a pellet-like fuel that is readily available, will burn cleaner than wood pellets, and is inexpensive, namely, corn kernels. The use of corn kernels, primarily U.S. Department of Agriculture grades 1 through 3 feed corn, provides the user with an inexpensive, clean and readily available fuel. It is estimated that there are over 4 billion bushels of suitable feed corn in storage facilities throughout the country and the supply is growing daily.

SUMMARY OF THE INVENTION

The above outlined objectives as well as other objectives and features of the present invention are accomplished by a pellet fuel burning heating unit having a balanced pressure system. The apparatus includes a blower system for providing combustion air into the burner under positive pressure and at the same time providing a negative pressure to remove the combustion gases from the burner area. A pressure regulator and air splitter maintains a balance between the positive and negative pressure and adjusts the air flow into the burner and out the exhaust. The blower air moves into the pressure regulator and air splitter dividing the air flow such that a portion enters the heating unit exhaust pipe to produce a negative pressure and a portion enters the heating unit burner under positive pressure.

BRIEF DESCRIPTION OF THE DRAWINGS

For a full understanding of the nature and objectives of the invention, reference should be made to the following detailed description taken in conjunction with the accompanying drawings in which:

FIG. 3 is a vertical sectional view taken along line 3—3 of FIG. 1;

FIG. 5 is a vertical sectional view taken along line 5—5 of FIG. 4;

FIG. 7 is a perspective view of the pressure regulator taken along line 7-7 of FIG. 5.

DESCRIPTION OF THE PREFERRED EMBODIMENT

Figure 1:
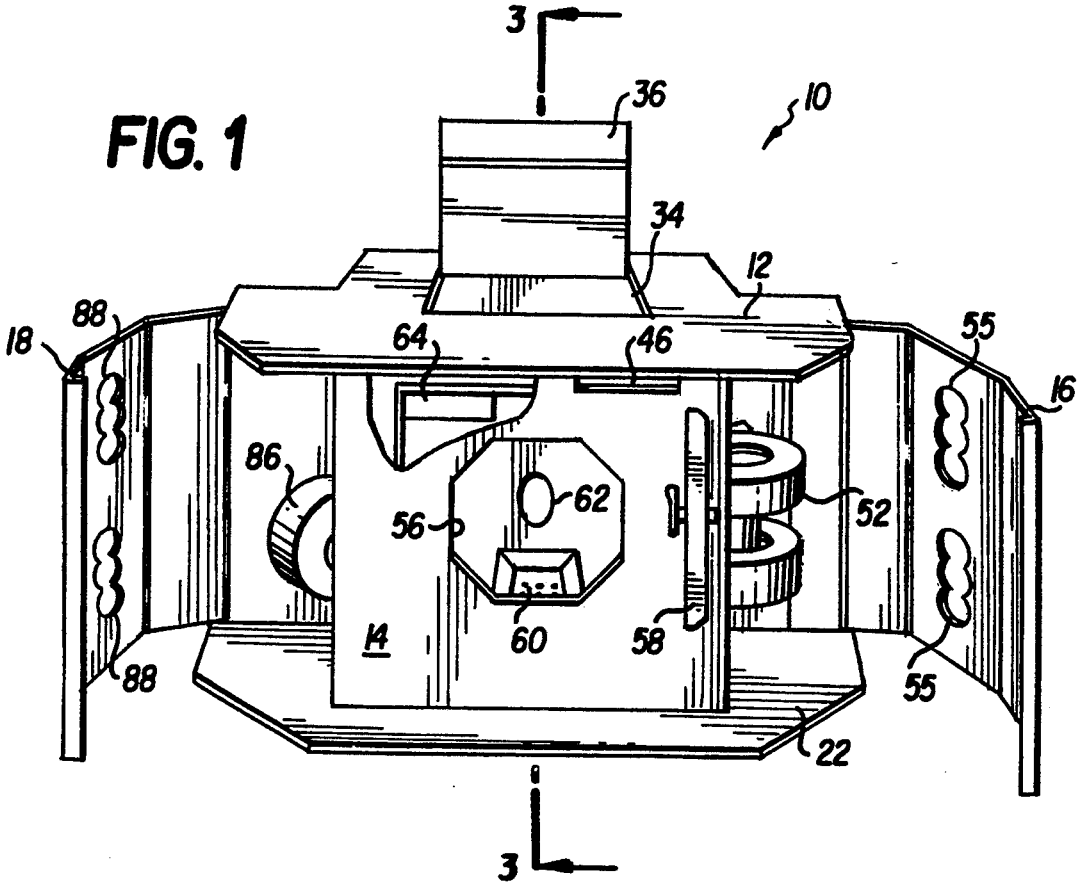
FIG. 1 is a perspective view, partially broken away showing a pellet fuel burning heating unit having a balanced pressure system in accordance with the invention.
Figure 2:
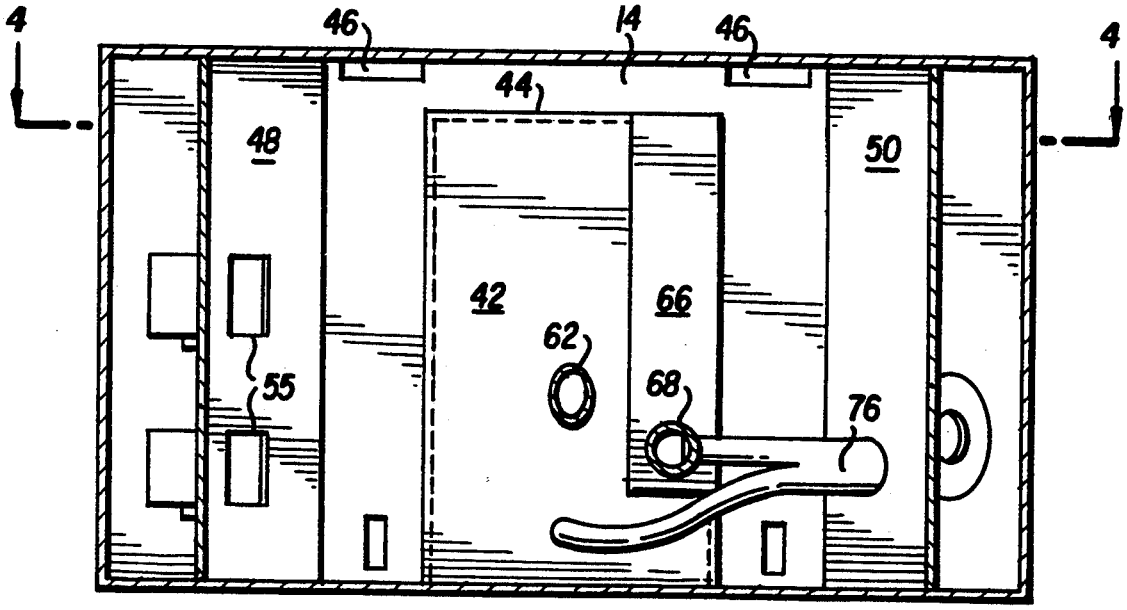
FIG. 2 is a rear view of the heating unit with the hopper removed.

Referring now to the drawings in detail, where like reference numerals indicate like parts throughout the several FIGURES, reference numeral 10 indicates a preferred embodiment of the corn or wood pellet burning heating unit of the present invention.

Figure 4:
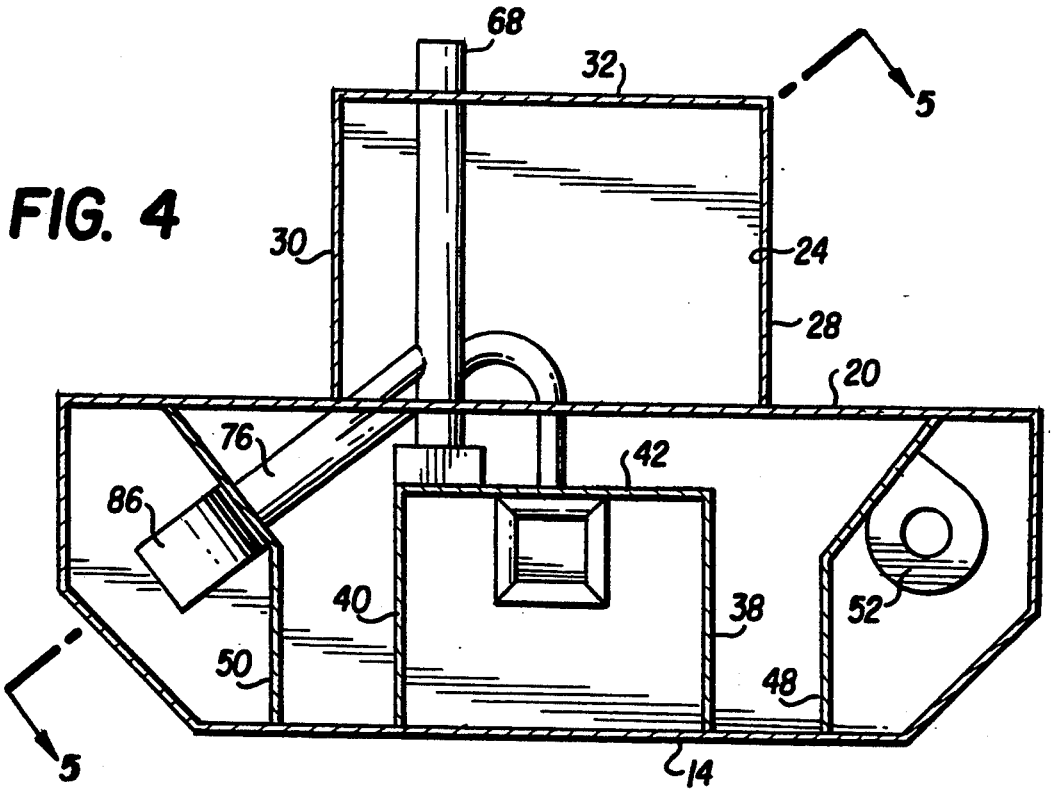
FIG. 4 is a horizontal sectional view taken along line 4—4 of FIG. 2 with the top wall, hopper bottom and auger feed removed.

As seen best in FIGS. 1, 3 and 4, the heating unit 10 has outer surfaces comprising top wall 12, front wall 14, hinged side walls 16 , 18, a rear wall 20 and a bottom wall 22. A hopper 24 is connected to rear wall 20 and includes a sloping bottom 26, side walls 28, 30 and rear wall 32. The hopper 24 is covered by top wall 12 and an access opening 34 is closed by a cover 36. Fuel to be placed in the hopper 24 is easily poured through opening 34 in top wall 12.

The heating unit 10 has a firebox formed by side walls 38, 40, rear wall 42, top wall 44, bottom wall 22 and front wall 14. As seen best in FIG. 3 , the top wall 44 of the firebox is spaced from the top wall 12 to define an upper heat flow channel having exit vents 46 in front wall 14. The spacing of firebox rear wall 42 from rear wall 20 and the spacing of firebox side walls 38, 40 from blower mount partitions 48, 50 respectively provides additional heat flow passages around the firebox. Air is circulated around the firebox by blower 52 affixed to partition 48. As the firebox walls are heated, the air circulating around the walls will extract heat from the walls and the heated air will exit through vents 46. The blower 52 may be activated by a thermostat (not shown) that will activate the blower only when the firebox walls reach a prescribed temperature. Access to blower 52 is through hinged side wall 16 which has a series of intake vents 54 thereon through which ambient air enters the blower 52 for circulating around the firebox walls. As is well known in the art, the outer surfaces of the firebox walls 38, 40, 42, 44 may have baffles thereon to move the circulating air from blower 52 in a slightly tortuous path about the walls to maximize the heat transfer from the walls to the air. Blower 52 is mounted on partition 48 so that the blower outlets are aligned with openings 55 in the partition 48.

The firebox has an access opening 56 in front wall 14 and a closure such as door 58 is mounted on the front wall to permit access to the firebox interior. Located within the firebox is a burner 60 in which the pellet fuel is burned. The fuel is dropped into the burner 60 through an opening 62 in firebox rear wall 42. As seen best in FIG. 1, an opening 64 in rear wall 42 provides an outlet for the combustion exhaust. A duct 66 communicates with opening 64 to move the exhaust downwardly into exhaust pipe. 68 through which the exhaust gases will vent outside of the building. As will be discussed, the balanced pressure system contributes in having the temperature of the exhaust gases relatively cool as compared to a typical wood burning heating unit so that the exhaust pipe 68 can be placed directly through an exterior wall.

The burner 60 has a hollow body with openings 70 in its lower surface 72 to provide combustion air directly to the fuel resting on the surface 72 . One side of the burner 60 is connected to one end of duct 74 which conveys the combustion air to the burner. The other end of duct 74 is connected to pressure regulator and air splitter 76.

The pressure regulator and air splitter 76 plays an important part in the efficient operation of the present invention and is preferably formed of 3" square steel tubing having an open inlet 78 at one end and a pair of outlet openings 80, 82 at the opposite end. A duct 84 preferably having a $1\frac{1}{2}''\times3''$cross section is connected to opening 82 and is attached to exhaust pipe 68 at a angle approximately of 25 degrees in such a manner that a lip 85 extends approximately 1" into exhaust pipe 68 which is preferably of 3" diameter. Duct 74 of preferably $1\frac{1}{2}''$ diameter is attached to opening 80 to provide combustion air to the burner. The pressure regulator and air splitter 76 is supported on partition 50 which has an opening therein of similar dimensions to inlet 78 of the pressure regulator and air splitter 76. Also supported on partition 50 is a blower 86 that draws ambient air from the surrounding area through intake vents 88 in hinged side wall 18 . The blower 86 may also be directly connected to an intake duct ( not shown) that will draw air from the outside of the building as is preferred with mobile home installations where oxygen deficiency may be a problem. Blower 86 is chosen to have sufficient capacity to provide sufficient air through outlets 80, 82 and a blower rated at 160 cubic feet per minute has been found adequate.

Figure 6:
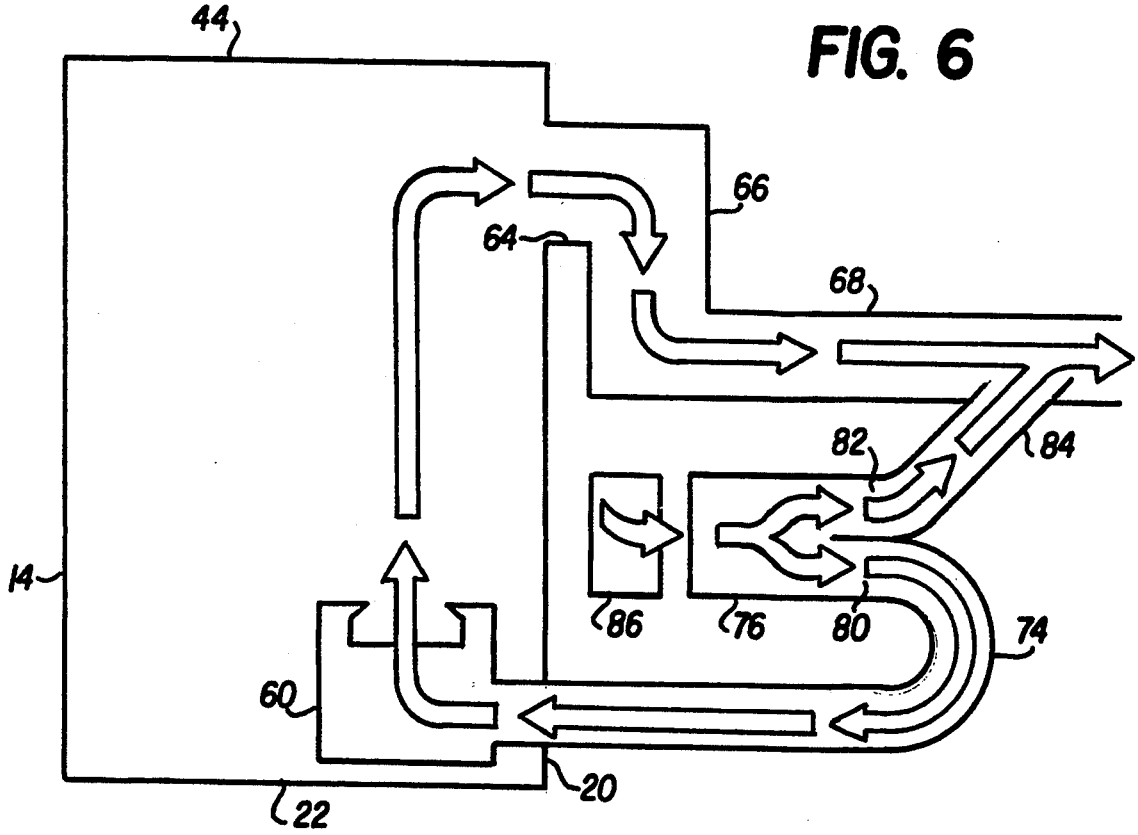
FIG. 6 is a schematic depiction of the pressure system of the heating unit.

The air from blower 86 enters the pressure regulator and air splitter 76 through inlet 78 and divides at outlet openings 80, 82 with a portion entering duct 74 to bring combustion air into burner 60 and a portion entering duct 84 to bring cooler air into exhaust pipe 68 . This air flow is seen best in the schematic showing in FIG. 6. The air from blower 86 enters pressure regulator and air splitter 76 and flows toward outlet openings 80, 82. Depending on the pressure differential between exhaust pipe 68 and duct 74, the air flow will divide at the outlet openings in such a manner to constantly balance the pressure in the firebox so that it is substantially near ambient pressure. The air entering exhaust pipe 68 from duct 84 along with the restricted flow in exhaust pipe 68 due to lip 85 provides a suction effect on the combustion exhaust without the need, as in the prior art, to have a blower directly in the exhaust pipe which blower can become clogged with the combustion products. A second benefit of providing fresh air directly into exhaust pipe 68 is that the temperature of the exhaust gases are substantially reduced by the mixing of the fresh cooler air and the heated combustion air from the firebox. It is believed that the lip 85 of duct 84 produces a turbulance and increased velocity of the exhaust gases thus increasing the suction effect in the firebox.

It has been found that the pressure regulator and air splitter 76 will continually keep the pressure system of the heating unit in a balanced state so that the burner 60 is not deprived of the needed combustion air. As the air enters the burner 60 there is produced a positive pressure in the firebox, more air is then shifted into duct 84 which causes a greater suction in exhaust pipe 68 which then pulls more air from the firebox thus reducing the pressure at the burner and in duct 74, thereby causing more air from the pressure regulator and air splitter 76 into outlet 80 and then into duct 74. When more pellets are added to the burner, the positive pressure in duct 74 will increase so that the pressure regulator and air splitter 76 will send more air into duct 84 which increases the negative pressure in the firebox which reduces the positive pressure in duct 74 thereby increasing the flow of air into duct 74 to provide more combustion air into burner 60.

The pellet or corn fuel is fed into burner 60 through chute 89 which communicates with opening 62 in firebox rear wall 42. The fuel is deposited into the chute by auger 90 having a generally helical flight 92 rotatable within a housing 94. The housing is open at its bottom to receive the pellet or corn fuel which continually moves toward the housing opening by hopper sloping bottom 26. The auger includes a motor 96 and the motor 96 can be connected to a control means (not shown) for regulating the amount of fuel fed to the burner 60.

The preferred fuel to be used in the heating unit 10 is corn kernels although wood pellets or a combination thereof has been successfully used. Corn is the fuel of choice because it is plentiful, is quickly renewable and burns clean and practically odor free.

From the preceding description, it should be evident that the objects of the invention are obtained. The pressure regulator and air splitter 76 takes a portion of the air from blower 86 and directs it through duct 84 into exhaust pipe 68 to produce a suction effect for the combustion gases. The remaining air is directed through duct 74 into burner 60 where the positive pressure provides the needed combustion air to burn fuel such as corn. An overall pressure balance is achieved such that the pressure in the firebox is substantially near equal to the ambient pressure of the surrounding area. It is believed that the increased pressure of the air in the pressure regulator and air splitter 76 due to the input of air from blower 86 and the slight restriction of flow through the outlets provides for the balancing of the pressure in the firebox by permitting the air flow through the outlets in the pressure regulator and air splitter to automatically adjust depending on the relative pressure in duct 84 and duct 74.

Although the invention is described and illustrated in detail, it is to be clearly understood that the same is by way of illustration and example only and is not to be taken by way of limitations. The spirit and scope of the invention is to be limited only by the terms of the appended claims.

What is claimed is:

1. A pellet burning heating unit including a firebox, a burner means within said firebox, air duct means connected to said burner means to provide combustion air to said burner means, exhaust duct means to remove combustion gases from said firebox, and air supply means including a blower and a divergent air splitter to deliver air to said air duct means and to said exhaust duct means, said air splitter having a single inlet to receive fresh air from said blower and having a pair of adjacent outlets diverging from and spaced from said inlet, one of said outlets in communication with said air duct means and the other of said outlets in communication with said exhaust duct means.

2. The heating unit of claim 1 wherein there is a first conduit means in communication with said other of said outlets, said exhaust duct means including an exhaust pipe extending from the outside of the firebox to outside of the heating unit, said first conduit means fluidically connected to said exhaust pipe at an acute angle whereby a suction is created in the portion of said exhaust pipe adjacent said firebox.

3. The heating unit of claim 1 wherein said first conduit means extends into said exhaust pipe to form a partial barrier to the flow of combustion gases in said exhaust pipe.

4. The heating unit of claim 3 wherein said firebox includes a rear wall having an outlet means in the upper portion thereof, said exhaust duct means in fluidic communication with said outlet means.

5. A heating unit comprising a firebox, a burner means in a lower portion of said firebox, an outlet means in an upper portion of said firebox, an exhaust duct means in communication with said firebox to remove combustion gases therefrom, a combustion air duct means connected to said burner means, and air supply means including an enclosed pressure regulator having a divergent air splitter to provide air into both said duct means to produce a suction in said exhaust duct means for said combustion gases and into said combustion air duct means, said pressure regulator positioned relative to said exhaust duct means and said combustion air duct means so as to vary the supply of air to both of said duct means depending on the relative pressure in both of said duct means.

6. The heating unit of claim 5, wherein said exhaust duct means includes an exhaust pipe and said air supply means further includes a blower means and said pressure regulator is between said blower means and said exhaust pipe.

7. The heating unit of claim 6, wherein there is a conduit between said pressure regulator and said exhaust pipe and said conduit is fluidically connected to said exhaust pipe at an acute angle.

8. The heating unit of claim 7, wherein said conduit extends into said exhaust pipe to form a partial barrier to the flow of combustion gases in said exhaust pipe.

9. The heating unit of claim 2, wherein said air duct means is a second conduit, said burner means has an inlet opening to receive one end of said second conduit and the other end of said second conduit is fluidically connected to said one of said outlets of said air splitter.

10. A fuel pellet burning heating unit comprising:

(a) firebox means;

(b) means for providing fuel pellets to be burned in said firebox means;

(c) means for holding fuel to be burned in said firebox means;

(d) first duct means connected to said fuel holding means to provide combustion air;

(e) exhaust means for removing combustion gases from said firebox means;

(f) second duct means to create a suction air exhaust flow in said exhaust means;

(g) air supply means for providing an air flow to said first and second duct means; and (h) air splitter means located between said air supply means and said first and second duct means, said air splitter means having an inlet means to receive air from said air supply means and a pair of outlet means to provide the air to said first and second duct means.

11. A fuel pellet heating unit as in claim 10, wherein said fuel holding means is a fuel pellet burner directly connected to said first duct means; said fuel pellet burner having an inner surface upon which fuel pellets are deposited thereon, said inner surface having a plurality of openings along its bottom and side through which the combustion air moves onto the fuel pellets.

12. A fuel pellet heating unit as in claim 11, wherein said inner surface of said fuel pellet burner is disposed inwardly at its upper side portions to restrict the combustion air movement from said fuel pellet burner to said exhaust means.

13. A fuel pellet heating unit as in claim 10, wherein said pair of outlet means are adjacent to each other and are spaced from the inlet of said air splitter means to provide a continuous volume of moving air in said air splitter means.

14. A fuel pellet burning heating unit comprising:

(a) firebox means;

(b) means for providing fuel pellets to be burned in said firebox;

(c) a fuel pellet burner to hold the fuel to be burned in said firebox, said fuel pellet burner being hollow and having an inner surface upon which fuel pellets are deposited thereon; said inner surface having a bottom portion and side wall portions with a plurality of openings in said bottom and side wall portions;

(d) air supply means directly connected to said fuel pellet burner to provide combustion air to said burner;

(e) exhaust duct means for removing combustion gases from said firebox means; and (f) blower means for directing air past said firebox means and into a space to be heated.

15. The fuel pellet burning heating unit of claim 14, wherein said fuel pellet burner has an outer surface spaced from said inner surface to enclose an air plenum through which said combustion air moves to enter said plurality of openings in said inner surface, and an opening in said outer surface to receive said air supply means.

16. The fuel pellet burning heating unit of claim 15, wherein said air supply means further includes a first and second duct means, said first duct means directly connected to said opening in said outer surface of said fuel pellet burner and a second duct means fluidically connected to said exhaust duct means.

17. The fuel pellet burning heating unit of claim 16, wherein an air splitter means is located between said first and second duct means and a source of combustion air, said air splitter means having a pair of outlets connected to said first and second duct means and an inlet to receive combustion air from said source.

18. A pellet burning heating unit including: a firebox, a burner means within said firebox, air duct means connected to said burner means to provide combustion air to said burner means, exhaust duct means to remove combustion gases from said firebox, and air supply means including a blower and an air splitter to deliver air to said air duct means and to said exhaust duct means, said air splitter having an inlet to receive fresh air from said blower and having a pair of outlets spaced from said inlet, one of said outlets in communication with said air duct means and the other of said outlets in communication with said exhaust duct means; a first conduit means in communication with said other of said outlets, said exhaust duct means including an exhaust pipe extending from the outside of the firebox to outside of the heating unit, said first conduit means fluidically connected to said exhaust pipe at an acute angle whereby a suction is created in the portion of said exhaust pipe adjacent said firebox; said air duct means comprising a second conduit, said burner means having an inlet opening to receive one end of said second conduit and the other end of said second conduit fluidically connected to said one of said outlets of said air splitter; and said pair of outlets being adjacent to each other and being spaced from the inlet of said air splitter to provide a continuous volume of moving air in said air splitter whereby said moving air is divided at said pair of outlets to enter said first and second conduits.

* * * * *